US006394458B2

(12) United States Patent
Chang

(10) Patent No.: US 6,394,458 B2
(45) Date of Patent: May 28, 2002

(54) SECTIONAL TARGET BOARD OF A DARTBOARD

(76) Inventor: Wen-Fang Chang, No. 2-1, Yi-Fu St., Yi-Hsin Li, Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/758,213

(22) Filed: Jan. 12, 2001

(30) Foreign Application Priority Data

Apr. 29, 2000 (TW) ..... 89207097 U

(51) Int. Cl.[7] ..... F41J 5/052
(52) U.S. Cl. ..... 273/376
(58) Field of Search ..... 273/371–376, 273/403, 404, 407, 408

(56) References Cited

U.S. PATENT DOCUMENTS 4,836,556 A * 6/1989 DeVale et al. ..... 273/376
5,275,418 A * 1/1994 Yiu ..... 273/376
5,482,291 A * 1/1996 Houriet et al. ..... 273/376
5,718,433 A * 2/1998 Lu et al. ..... 273/374
5,788,244 A * 8/1998 Hui et al. ..... 273/374
5,848,792 A * 12/1998 Brejcha ..... 273/376
6,047,968 A * 4/2000 Lu et al. ..... 273/371
6,089,571 A * 7/2000 Cho ..... 273/371
6,116,607 A * 9/2000 Cho ..... 273/371

* cited by examiner

*Primary Examiner*—Mark S. Graham
(74) *Attorney, Agent, or Firm*—Rabin & Derdo, P.C.

(57) ABSTRACT

A sectional target board of a dartboard consists of a grid frame having a plurality of receiving spaces for different score sectors, a plurality of target plates movably received in the plurality of receiving spaces, and a grid fixed on a the grid frame. The grid has a ring recess to receive the front end of the grid frame, and provides with a plurality of fastening pins which are respective inserted into corresponding plurality of fastening holes of the grid fame. The grid can be easily detached from the grid frame to free the target plates, thus the soft target blocks can be easily replaced, and then the grid can be reassembled on the grid frame. In such a way the soft target blocks are saved, and only the worn blocks need to be replaced. Thus, the sectional target board of the dartboard is economical.

6 Claims, 7 Drawing Sheets

SECTIONAL TARGET BOARD OF A DARTBOARD

BACKGROUND OF THE INVENTION

1. Field of the Invention

The present invention relates to a sectional target board of a dartboard, wherein a plurality of target plates is respectively fitted in a plurality of receiving spaces of a grid frame, and soft target blocks fitted in the target plates are able to be separately replaced after becoming worn.

2. Description of Related Art

With reference to FIG. 7, a conventional dartboard generally comprises an integrally formed target board (70), a metal grid (71) having a different score sectors and being mounted on a front end of the target board (70), and an outer metal ring (72) enclosing the target board (70) therein. In the game of darts, certain score sectors are frequently targeted by players which leads to above-average wear of those score sectors and below-average wear of other score sectors. Thus, after long-term use of the target board (70) a large amount of small pits are formed on surfaces of these sectors, which prevents darts from sticking well on these sectors again. Thus, these sectors are no longer useful and because the target board (70) is integrally formed, the whole target board (70) has to be discarded.

Therefore, it is an objective of the invention to provide an improved sectional target board of a dartboard to mitigate and/or obviate the aforementioned problems.

SUMMARY OF THE INVENTION

The object of the invention is to provide a sectional target board of a dartboard, which comprises a grid frame having a plurality of receiving spaces for different score sectors, a plurality of target plates respectively fitted in the plurality of receiving spaces of the grid frame, a grid fixed on a front end of the grid frame, an outer ring enclosing the grid frame, a rear board securely mounted at rear ends of the grid frame and the outer ring, and an electric circuit board mounted on a rear end of the rear board. Wherein the grid has a plurality of ribs which are each formed with a C-shaped cross section and defined with a ring recess to receive the front end of the grid frame fitted therein. When the soft target blocks of the dartboard are hit frequently by darts and so become worn, the grid can be easily detached from the grid frame to free the target plates from the grid frame, and thus the soft target blocks can be easily replaced, whereafter the grid can be reassembled on the grid frame. In such a way, the soft target blocks which are not hit by darts so frequently are saved, and the cost of the dartboard is economical.

Other objects, advantages and novel features of the invention will become more apparent from the following detailed description when taken in conjunction with the accompanying drawings.

DETAILED DESCRIPTION OF THE PREFERRED EMBODIMENT

Figure 1:
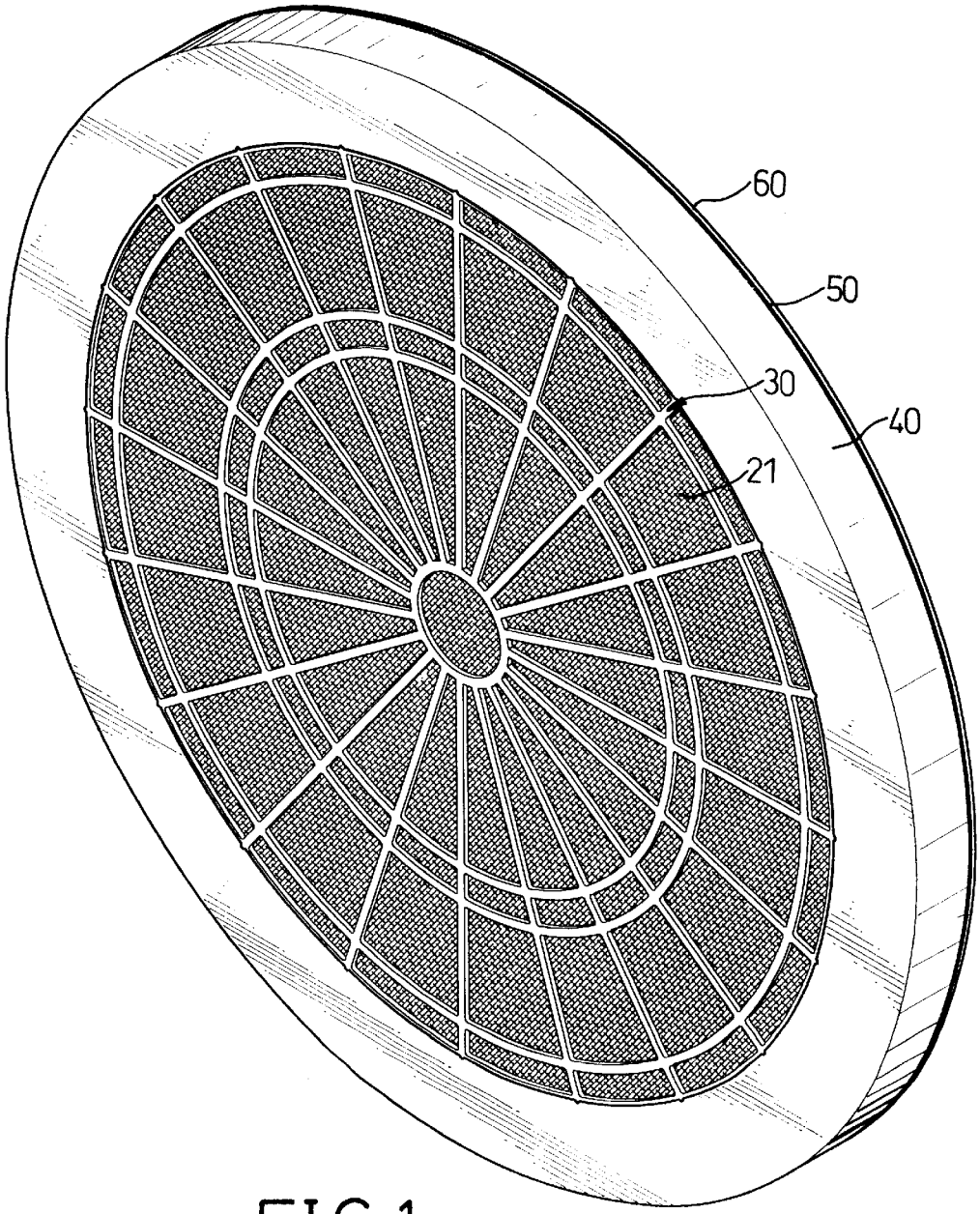
FIG. 1 is a perspective view of a sectional target board of a dartboard in accordance with the invention.
Figure 2:
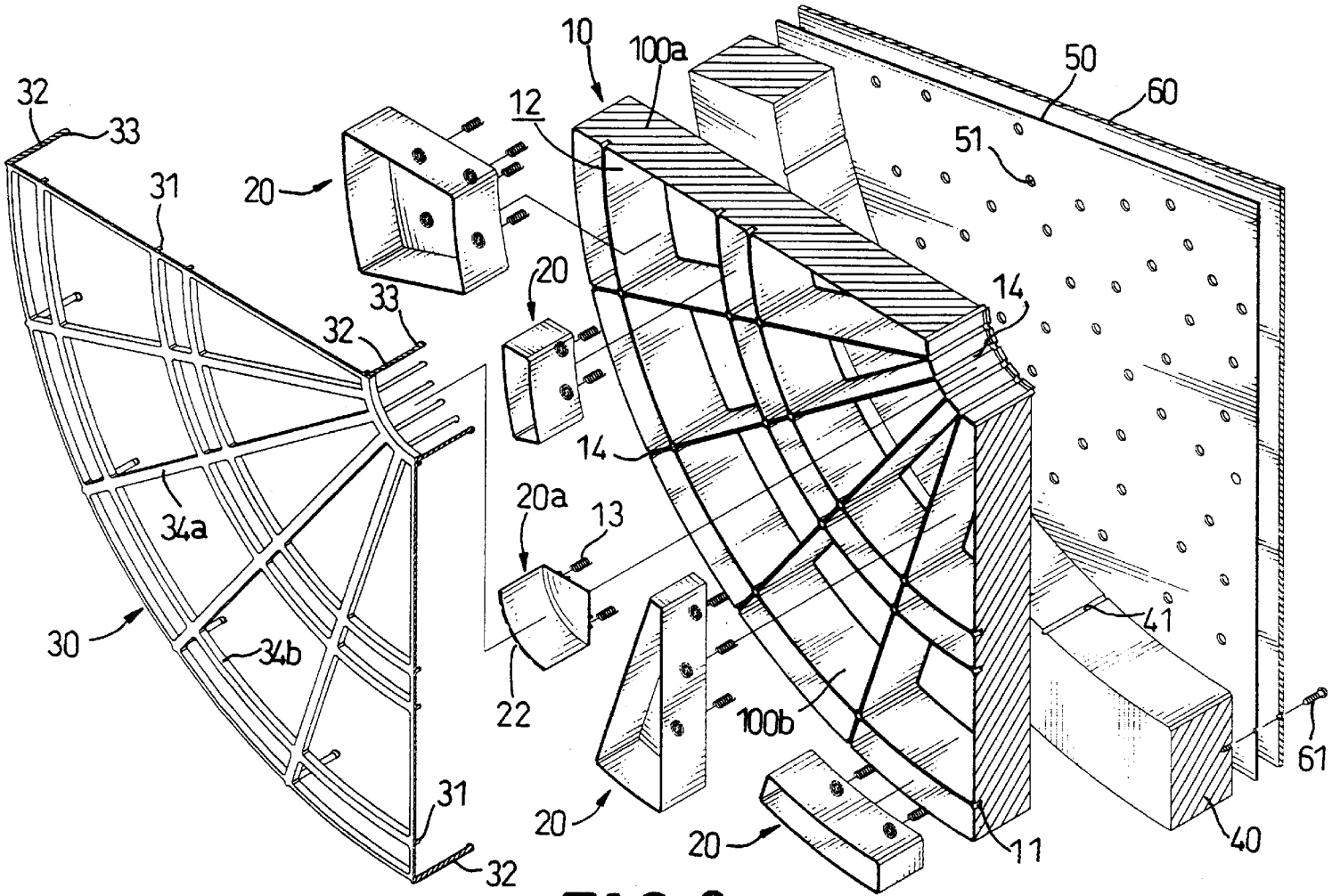
FIG. 2 is a partial exploded perspective view of the sectional target board of the dartboard in accordance with the invention.

With reference to FIGS. 1 and 2, a sectional target board of a dartboard in accordance with the present invention comprises a grid frame (10), which is defined with a plurality of receiving spaces (12) shaped according to different score sectors of the dartboard, a plurality of target plates (20) including a central target plate (20*a*) respectively fitted in the corresponding receiving spaces (12), a grid (30) assembled on a front end of the grid frame (10), an outer ring (40) enclosing the grid frame (10), a rear board (50) securely mounted on rear ends of the grid frame (10) and the outer ring (40), and an electric circuit board (60) mounted on a rear end of the rear board (50).

The grid frame (10) is formed with a plurality of radial panels (100*a*) and annular panels (100*b*). Each one of a group of cross-points of the radial panels (100*a*) and annular panels (100*b*) is defined with a blind hole (11). Each receiving space (12) is provided with a plurality of springs (13) therein, whereby the target plates (20) and the central target plate (20*a*) are axially movable between the grid (30) and the rear board (50). An inner side surface of an inner one of the annular panels (100*b*) and an outer side surface of an outer one of the annular panels (100*b*) of the grid frame (10) are respectively defined with a plurality of axially extending slots (14).

Each one of the target plates (20) and the central target plates (20*a*) has a recess filled with a soft target block (21). The target plates (20) and the central target plate (20*a*) each has a thickness smaller than a thickness of the grid frame (10). The central target plate (20*a*) is fitted and enclosed in the inner one of the annular panel (100*b*) of the grid frame (10), and defined with a plurality of axially extending slots (22) around an outer side surface thereof corresponding to the plurality of slots (14) defined in the inner side surface of the inner one of the annular panels (100*b*). Each slot (22) combines with a corresponding slot (14) to form a fastening hole.

The grid (30) is formed with a plurality of radial ribs (34*a*) and annular ribs (34*b*) corresponding to the plurality of radial panels (100*a*) and annular panels (100*b*) of the grid frame (10), and a plurality of projected dots (31) corresponding to the plurality of blind holes (11) of the grid frame (10). An inner one and an outer one of the annular ribs (34*b*) of the grid (30) are respectively and integrally formed with a plurality of axially extending fastening pins (32) corresponding to the plurality of axially extending slots (14) of the grid frame (10).

Figure 3:
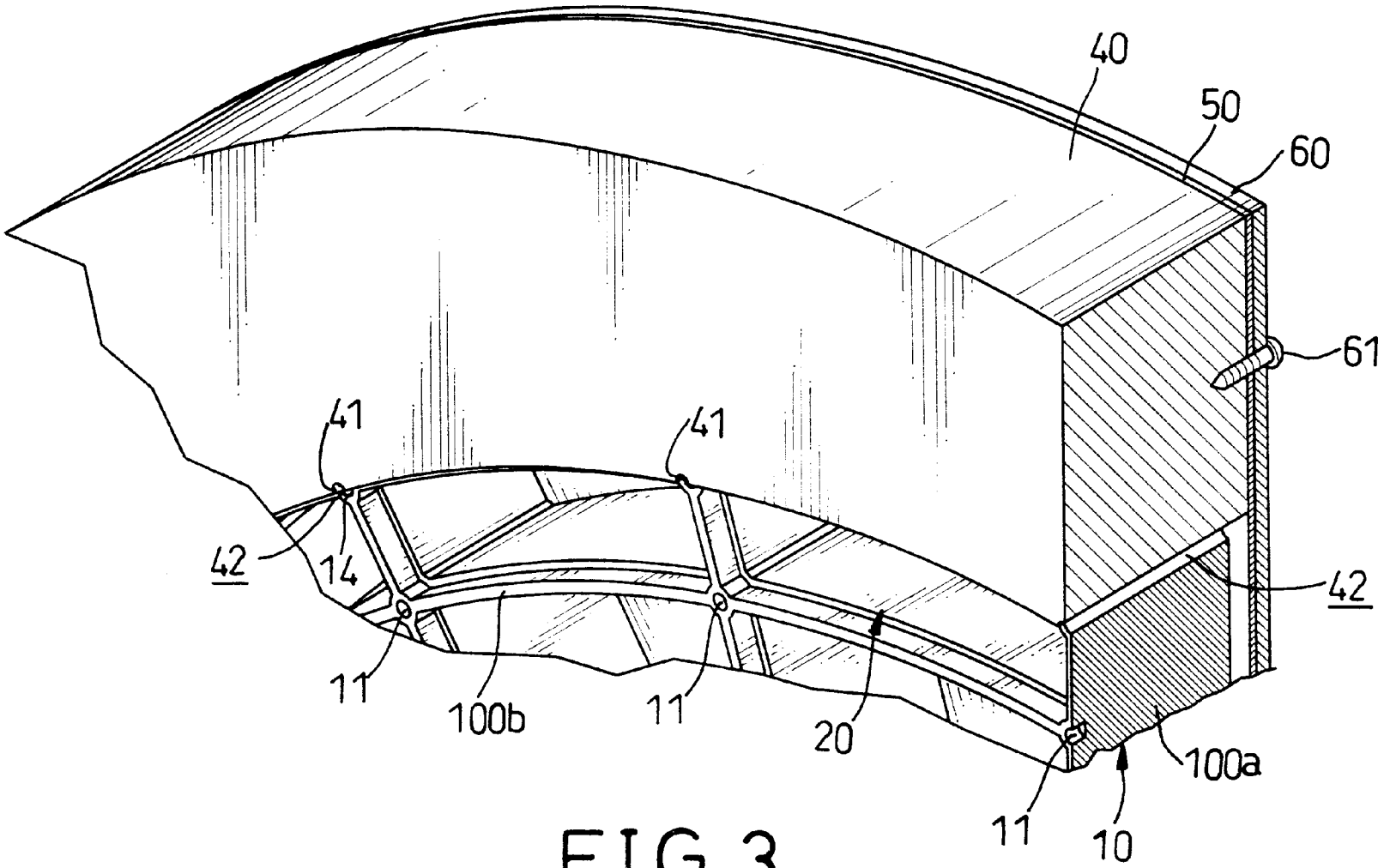
FIG. 3 is a partial cross-sectional view of the sectional target board of the dartboard in accordance with the invention, showing a grid frame assembled with an outer ring of the dartboard.

With reference to FIG. 3, the grid frame (10) is enclosed in the outer ring (40). The outer ring (40) has an inner side surface defined with a plurality of axially extending slots (41) corresponding to the axially extending slots (14) defined in the outer side surface of the outer one of the annular panels (100*b*) of the grid frame (10). Each slot (41) combines with a corresponding one of the slots (14) to form a fastening hole.

As shown in FIG. 1, the rear board (50) is defined with a plurality of eyes (51) corresponding to the plurality of springs (13) received in the receiving spaces (12). The rear board (50) and the electric circuit board (60) are securely mounted on the rear ends of the grid frame (10) and the outer ring (40) and fixed by means of screws (61) which are threadingly extended through the electric circuit board (60), the rear board (50), and threadingly engaged with the outer ring (40).

Figure 4:
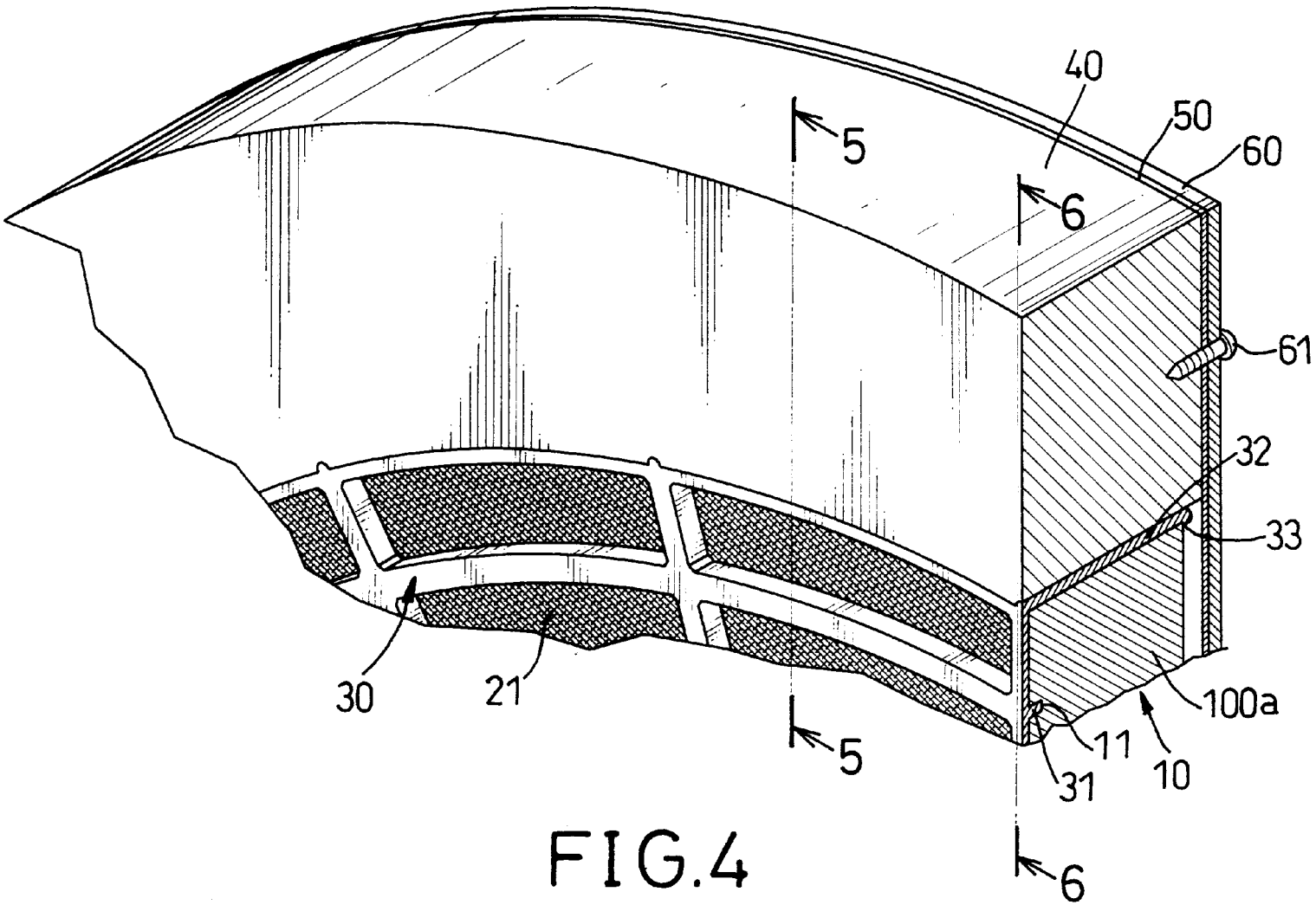
FIG. 4 is a partial cross-sectional view of the sectional target board of the dartboard in accordance with the invention, showing a grid assembled on the grid frame of the dartboard.
Figure 5:
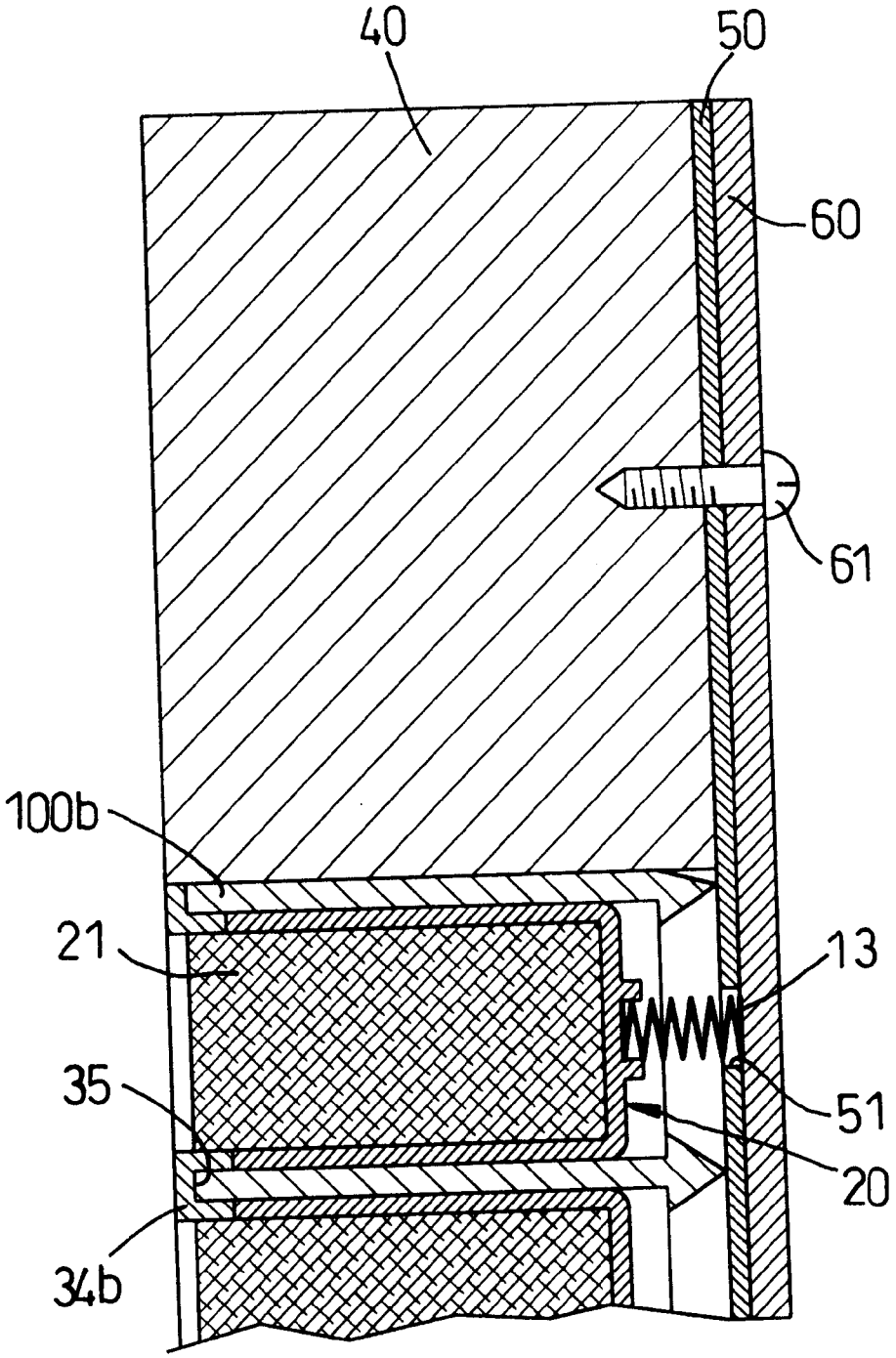
FIG. 5 is a cross sectional view of the sectional target board of the dartboard along line 5—5 in FIG. 4.
Figure 6:
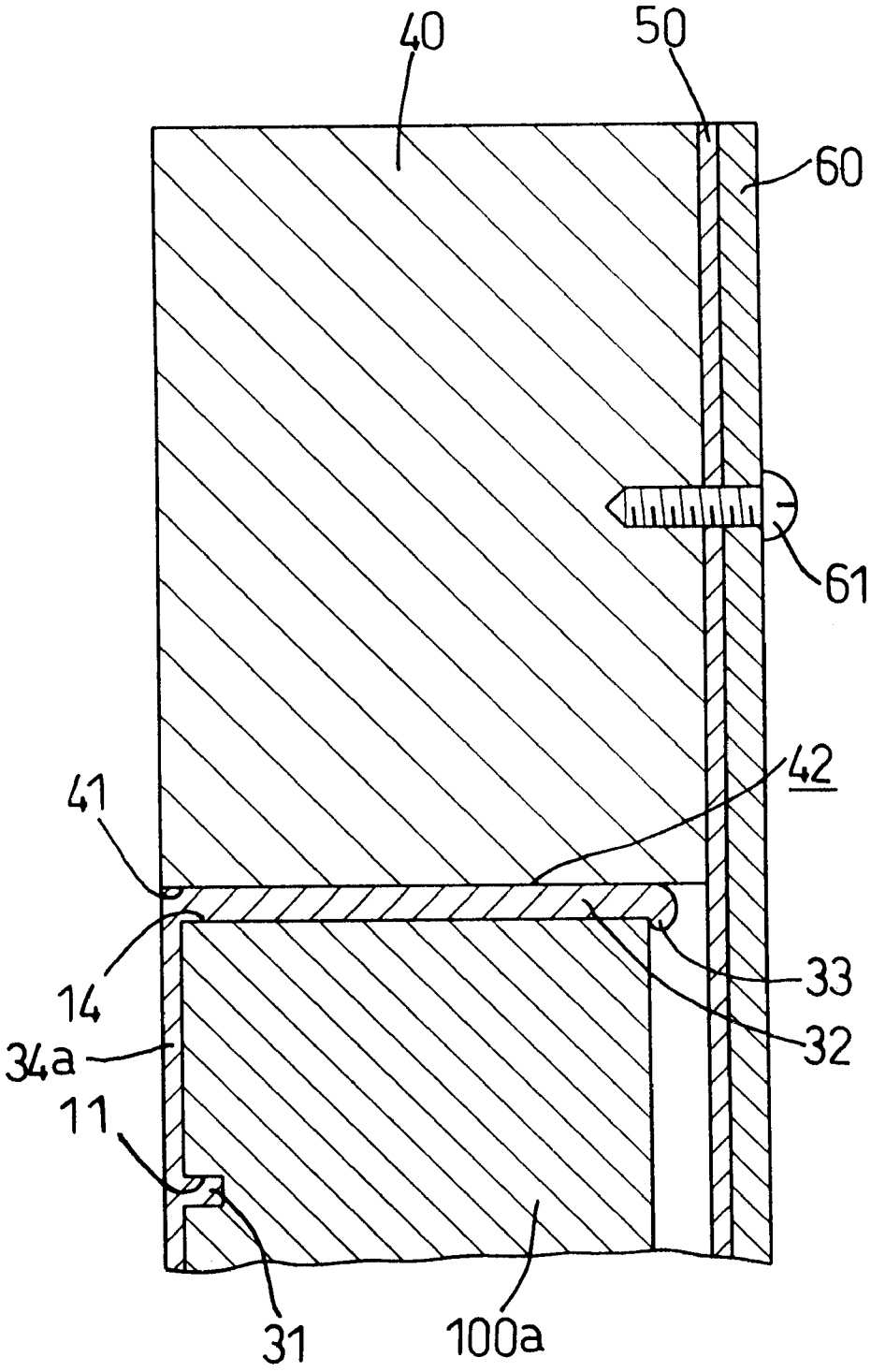
FIG. 6 is a cross sectional view of the sectional target board of the dartboard along line 6—6 in FIG. 4.
Figure 7:
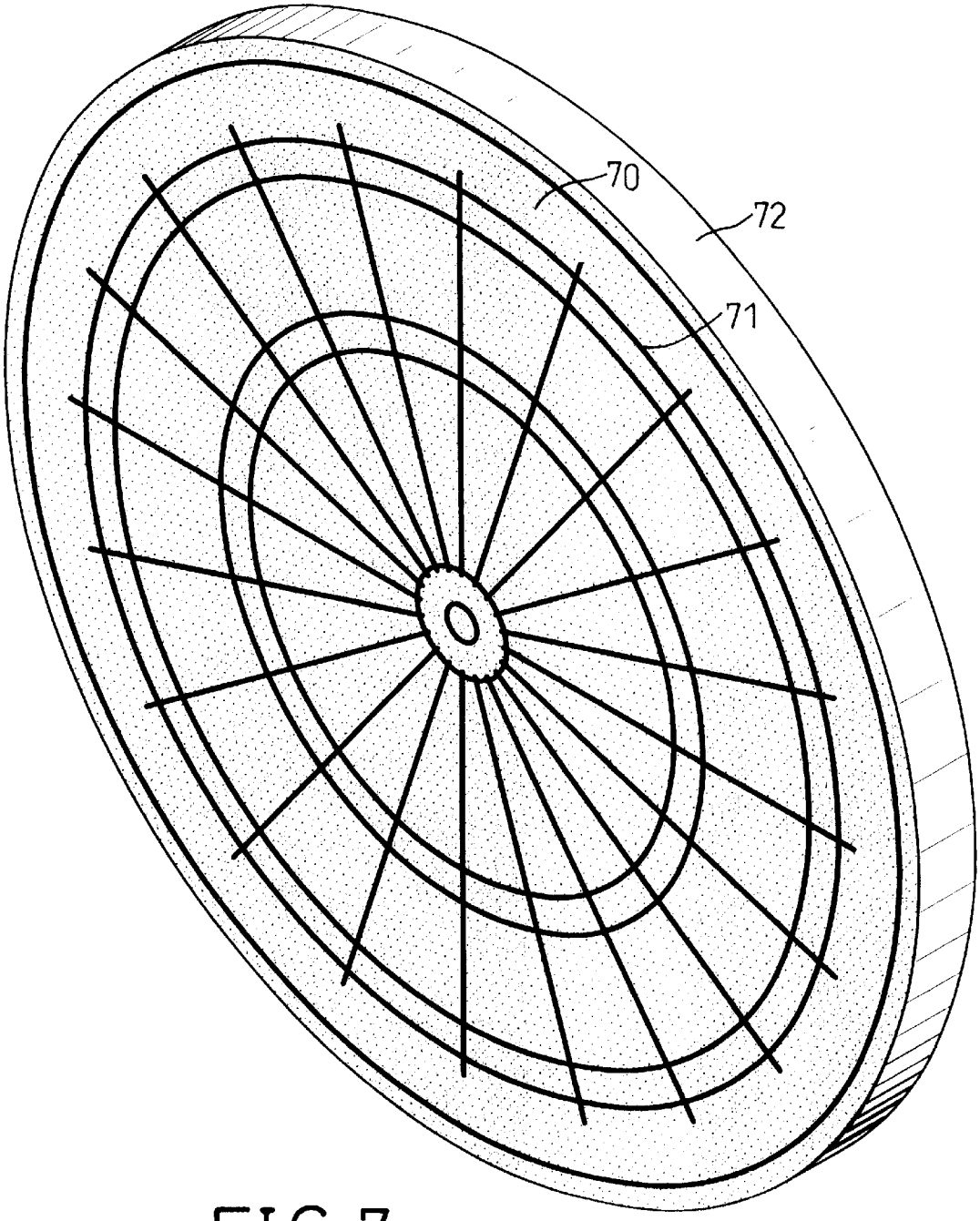
FIG.7 PRIOR ART
FIG. 7 is a perspective view of a conventional dartboard.

As illustrated in FIGS. 4, 5 and 6, which show the grid (30) is assembled on the front end of the grid frame (10), the plurality of radial ribs (34*a*) and annular ribs (34*b*) are formed with a C-shaped cross section and defined with an inter-communicated ring recess (35) corresponding to front ends of the radial panels (100*a*) and the annular panels (100*b*). The plurality of projected dots (31) are formed in the ring recess (35) of the grid (30). The front ends of the plurality of radial panels (100*a*) and annular panels (100*b*) of the grid frame (10) are correspondingly fitted in the recess part (35) of the plurality of radial ribs (34*a*) and annular ribs (34*b*) of the grid (30). A rear end of the grid (30) presses against front ends of the target plates (20) and the central target plate (20*a*). The projected dots (31) are respectively fitted into the corresponding blind holes (11). The fastening pins (32) are respectively inserted into the corresponding fastening holes, which are respectively combined together by the slots (22) and the corresponding slots (14) of the inner side surface of the inner one of the annular panel (100*b*) of the grid frame (10), and the slots (41) and the corresponding slots (14) of the outer side surface of the outer one of the annular panel (100*b*) of the grid frame (10). Each one of the fastening pins (32) has a hook (33) formed at a lower end thereof and fastened at the rear end of the grid frame (10). Whereby the target plates (20) and the central target plate (20*a*) respectively received in the receiving spaces (12) of the grid frame (10) are axially movable between the grid (30) and the rear board (50).

If the soft target blocks (21) fitted in the target plates (20) and the central target plate (20*a*) need to be replaced, the grid (30) can be easily detached from the grid frame (10) to free the target plates (20) and the central target plate (20*a*) from the grid frame (10), thus the target plates (20) and the central target plate (20*a*) can be withdrawn from the receiving spaces (12), and worn soft target blocks (21) can be easily replaced. Then the target plates (20) and the central target plate (20*a*) are respectively fitted into the relative receiving recesses (12) again, and the grid (30) is reassembled on the front end of the grid frame (10). The projected dots (31) are respectively fitted into the corresponding dot holes (11). The fastening pins (32) are respectively inserted into the fastening holes. In such a way the soft target blocks (21) of the target plates (20) and the central target plate (20*a*) can be easily replaced, and the cost of the sectional target board of the dartboard of the invention is economical.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sectional target board of a dartboard, the sectional target board comprising a grid frame (10), which is formed with a plurality of radial panels (100*a*) and annular panels (100*b*) and therein defined with a plurality of receiving spaces (12) shaped according to score sectors of the dartboard, wherein an inner one of the annular panels (100*b*) of the grid frame (10) has an inner side surface thereof defined with a plurality of axially extending slots (14) therearound;

a plurality of target plates (20) and a central target plate (20*a*) respectively shaped to correspond to and movably received in the plurality of receiving spaces (12), wherein an outer side surface of the central target plate (20*a*) is defined with a plurality of axially extending slots (22) corresponding to the plurality of axially extending slots (14) defined on the inner side surface of the inner one of the annular panel (100*b*) of the grid frame (10), each one of the slots (22) combines with one corresponding slot (14) to form a fastening hole;

a grid (30) having a plurality of radial ribs (34*a*) and annular ribs (34*b*), which are formed with a C-shaped cross section and defined with an inter-communicated ring recess (35) along their length direction corresponding to the plurality of radial panels (100*a*) and annular panels (100*b*) of the grid frame (10), and formed around an inner one of the annular ribs (34*b*) with a plurality of axially extending fastening pins (32) corresponding to the fastening holes, each one of the fastening pins (32) has a lower end thereof formed with a hook (33);

when the grid (30) is assembled on the grid frame (10), front ends of the plurality of radial panels (100*a*) and annular panels (100*b*) of the grid frame (10) are respectively fitted in the ring recess (35) of the plurality of radial ribs (34*a*) and annular ribs (34*b*) of the grid (30), the fastening pins (32) of the grid (30) are respectively inserted into the corresponding fastening holes, the hooks (33) of the fastening pins (32) are respectively fastened at a rear end of the grid frame (10); whereby the target plates (20) and the central target plate (20*a*) are respectively movable in the receiving spaces (12).

2. The sectional target board of the dartboard as claimed in claim 1, wherein each one of a group of cross-points of the radial panels (100*a*) and annular panels (100*b*) of the grid (10) is defined with a blind hole (11), and the grid (30) is formed with a plurality of projected dots (31) in the ring recess (35) thereof corresponding to the plurality of blind holes (11) of the grid frame (10).

3. The sectional target board of the dartboard as claimed in claim 1, wherein the grid frame (10) is enclosed with an outer ring (40) and defined with a plurality of axially extending slots (14) around an outer side surface of an outer one of the annular panels (100*b*) thereof, an inner side surface of the outer ring (40) is defined with a plurality of axially extending slots (41) corresponding to the slots (14) defined around the outer side surface of the outer one of the annular panels (100*b*) of the grid frame (10), each one of the plurality of slots (41) combines with a corresponding slot (14) to form a fastening hole.

4. The sectional target board of the dartboard as claimed in claim 3, wherein a rear board (50) is securely mounted at rear ends of the grid frame (10) and the outer ring (40).

5. The sectional target board of the dartboard as claimed in claim 4, wherein each one of the receiving spaces (12) of the grid frame (10) is provided with a plurality of springs (13), the rear board (50) is defined with a plurality of eyes (51) corresponding to the plurality of the springs (13), and an electric circuit board (60) is securely mounted on a rear end of the rear board (50).

6. The sectional target board of the dartboard as claimed in claim 5, wherein a plurality of screws (61) are respectively and threadingly extended through the electric circuit board (60) and the rear board (50), and threadingly engaged into the outer ring (40).

* * * * *